United States Patent [19]

Meinecke et al.

[11] Patent Number: 4,684,444

[45] Date of Patent: Aug. 4, 1987

[54] SORTER FOR PAPER PULP SUSPENSIONS INCLUDING A DAMPING CHAMBER

[75] Inventors: Albrecht Meinecke, Heidenheim; Hans-Rainer Schmid, Nattheim; Dieter Egelhof, Heidenheim, all of Fed. Rep. of Germany

[73] Assignee: J.M. Voith GmbH, Fed. Rep. of Germany

[21] Appl. No.: 821,075

[22] Filed: Jan. 21, 1986

[30] Foreign Application Priority Data

Jan. 31, 1985 [DE] Fed. Rep. of Germany ..... 3503241

[51] Int. Cl.[4] ..... D21D 5/02; D21D 5/22; B07B 1/20

[52] U.S. Cl. ..... 162/380; 209/273; 209/306; 210/349; 210/397

[58] Field of Search ..... 162/4, 380, 55, 336, 162/340, 341, 342; 209/250, 273, 300, 306, 255–257; 210/349, 397, 402

[56] References Cited

U.S. PATENT DOCUMENTS 3,692,183 9/1972 Tra ..... 209/273
4,126,513 11/1978 Justus et al. ..... 962/380
4,316,768 2/1982 Goddard ..... 209/306

FOREIGN PATENT DOCUMENTS 2751949 5/1978 Fed. Rep. of Germany .
1600477 9/1970 France .
1492209 11/1977 United Kingdom .

OTHER PUBLICATIONS

Das Papier, Book 1, 1980, pp. 5–11.
Das Papier, Book 10A, 1978, pp. V149–V150.

*Primary Examiner*—S. Leon Bashore
*Assistant Examiner*—K. M. Hastings
*Attorney, Agent, or Firm*—Ostrolenk, Faber, Gerb & Soffen

[57] ABSTRACT

A sorter for paper pulp suspension including a rotationally symmetrical wire cage and a rotor supporting a plurality of vanes for rotating about the interior of the cage for moving suspension through the wire cage, the vanes being non-uniformly spaced. An annular pulp chamber surrounds the screen for collecting the pulp. A suspension outlet at the bottom of the pulp chamber receives the pulp from the pulp chamber. The pulp chamber extends axially beyond the lower end of the wire cage. An annular damping chamber surrounds the lower end of the pulp chamber and flow from the pulp chamber to the pulp outlet is past the damping chamber. The damping chamber develops a pool of the suspension in it. A pressurized gas cushion above the pool of suspension in the damping chamber controls the level thereof and damps the motion of the pulp in the pulp chamber.

11 Claims, 2 Drawing Figures

SORTER FOR PAPER PULP SUSPENSIONS INCLUDING A DAMPING CHAMBER

BACKGROUND OF THE INVENTION

The invention relates to a sorter, and particularly a screen sorter, for paper pulp suspensions. The sorter is of the kind comprising a stationary, rotationally symmetrical wire cage, in the peripheral vicinity of which screening vanes are pivoted, an inlet for feeding the suspension into the cage, a pulp chamber surrounding the cage and a pulp outlet from the pulp chamber.

Such a sorter is known from U.S. Pat. No. 3,692,183.

Such sorters, in which the wire cage has appropriately fine perforations, are also used a short distance in front of the breast box or headbox of a paper machine for fine grading. It appears that the screening vanes rotating in front of the wire cage produce ripples in the flow of suspension which become noticeable as far back as the breast box and which give rise to streakiness in the paper because of fluctuations in the surface-related pulp. One remedy is to use the subdivided screening vanes as described in the above noted U.S. patent.

Moreover, a damper consisting of a tall, upright cylinder having an upper cushion of air has been added to the pipe leading to the breast box (see "Das Papier", Book 1, 1980, Page 8). In accordance with German Patent Specification No. 27 51 949, for this purpose, another special device has been developed in which the suspension passes through a cylindrical annulus, which is separated from a damping chamber by an elastic membrane. In the damping chamber is fluid, on the upper, free surface of which a cushion of air rests, and the pressure of the air cushion can be controlled. However, such a pressure pulsation damper is relatively expensive and requires more space. Furthermore, according to the first named document, it appears that the pulsations coming from a vertical screen cannot be eliminated with such a damping device.

SUMMARY OF THE INVENTION

The object of the invention is to provide measures which further decrease transmission of pulsations caused by such sorters. This object is achieved with a sorter of the kind referred to above which sorts and screens a paper pulp suspension. The sorter comprises a screen in the form of a stationary, rotationally symmetrical wire cage. Internally of the wire cage and in its immediate peripheral vicinity are disposed rotating screening vanes which rotate around a central axis and past the screen. There is an inlet above the screen for feeding the suspension into the cage. A pulp chamber surrounds the cage for receiving the pulp that has passed through the wire screen cage. There is a pulp outlet from the bottom of the pulp chamber, i.e., the end of the pulp chamber opposite the pulp inlet. Furthermore, there is a second outlet below the wire cage which communicates into the cage and receives therefrom any suspension material which has not passed through the wire screen cage to the pulp chamber, as would occur with heavy or large fibers and materials, etc.

According to the invention, an annular pulp damping chamber surrounds the pulp chamber at least over a part of the axial length of the pulp chamber near the outlet bottom end thereof and at the pulp outlet. The damping chamber communicates with the annular pulp chamber and with the pulp outlet, so that a pool of the pulped, sorted suspension forms in the damping chamber part way up around the surrounding annular wall of the pulp chamber. The outlet and damping chamber are so placed that the pulp flows through at least a part of the damping chamber to the pulp outlet.

A pressurized cushion of gas is defined in the damping chamber above the pool of suspension, and the gas pressure is controllable and is usually controlled approximately according to the pressure in the sorter. To avoid undesired fluid flow conditions, the vanes are non-uniformly arrayed around the rotor at different angular spacings one from another.

BRIEF DESCRIPTION OF THE DRAWINGS

Further objects and features of the invention are apparent from one embodiment of sorter which is now described with reference to the accompanying drawings, in which.

DESCRIPTION OF THE PREFERRED EMBODIMENT

Figure 1:
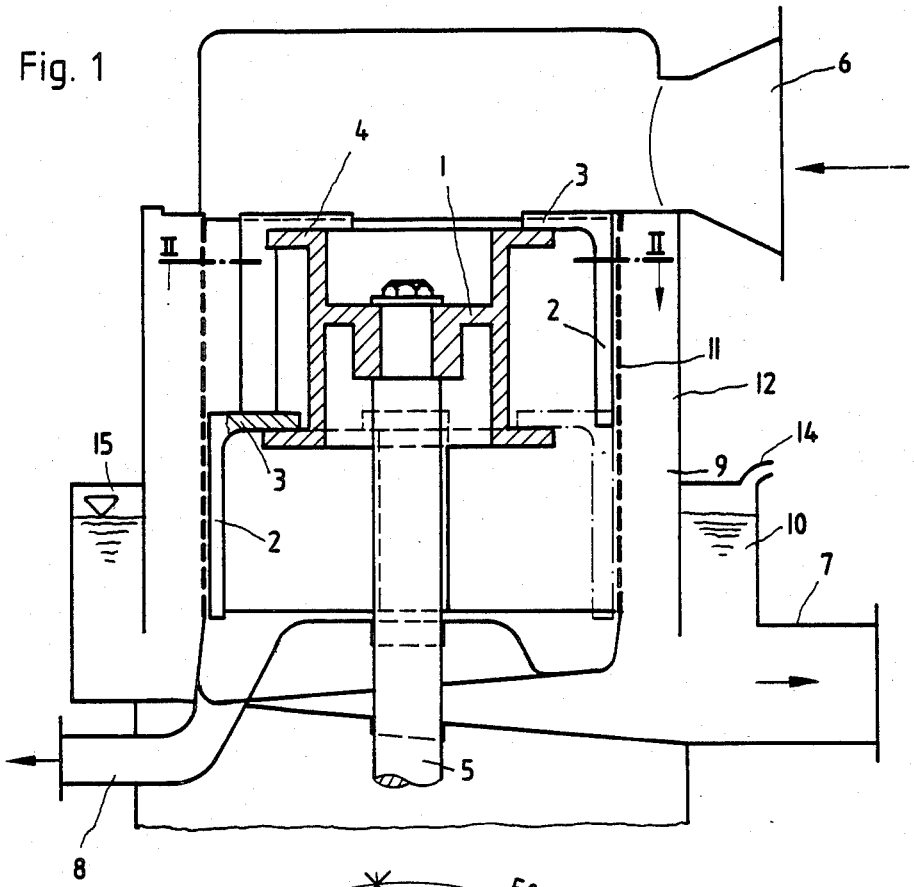
FIG. 1 is a vertical section through the sorter, on the line I—I of FIG. 2; and, FIG. 2 is a cross-section on the line II—II of FIG. 1.

Referring to FIG. 1, the sorter is arranged vertically and has a rotor 1 at its center, which carries screening vanes 2 on flanges 4 via mountings 3 fixed to the rotor. The screening vanes are rotatably arranged closely along the interior of the vertical screen which is in the form of a wire cage 11. A vertical shaft 5 drives the rotor 1 to rotate. The vanes may also be arranged along the exterior of the wire cage.

Suspension is supplied via feed pipes 6 above the rotor. The through-flow suspension, i.e. the portion of the suspension which does not pass through the wire cage 11 into the pulp chamber 9, is removed beneath the cage via removal pipes 8. The pulp that has passed through the perforations of the wire cage 11 and is collected in the pulp chamber 9 is also removed via outlet pipes 7 vertically beneath the cage.

The pulp chamber 9 is surrounded by an annular damping chamber 10 which is in direct communication with that axial end of the pulp chamber 9 furthest from the inlet feed pipe 6. The annular cross section of the damping chamber 10 should be between 1 and 10 times the annular cross section of the pulp chamber 9.

The housing wall 12 defining the pulp chamber 9 is extended into the chamber 10 in the axial direction beyond the end of the wire cage 11. This extension of the wall 12 can be considerably increased in order to shield the outlet pipes 7 from the direct effect of the pressure pulsations produced by the screening vanes 2. Of course, with such a vertical sorter, the floor of the damping chamber 10 also has to be displaced downward by a corresponding amount. The damping chamber 10 is an annulus, having a free liquid surface, as shown at 15. Above the liquid surface, there is a cushion of gas, such as air, whose pressure can be controlled via a connection line 14. The pressure of the cushion of air is adjusted substantially to the mean pressure prevailing in the sorter.

A membrane to separate the two phases in the damping chamber 10 may be dispensed with if, as in this case, a vertical axis arrangement of the sorter is used. With a horizontal arrangement, i.e. with a horizontal shaft 5, the two phases air/fluid should be separated by a membrane, e.g. one made of rubber.

Figure 2:
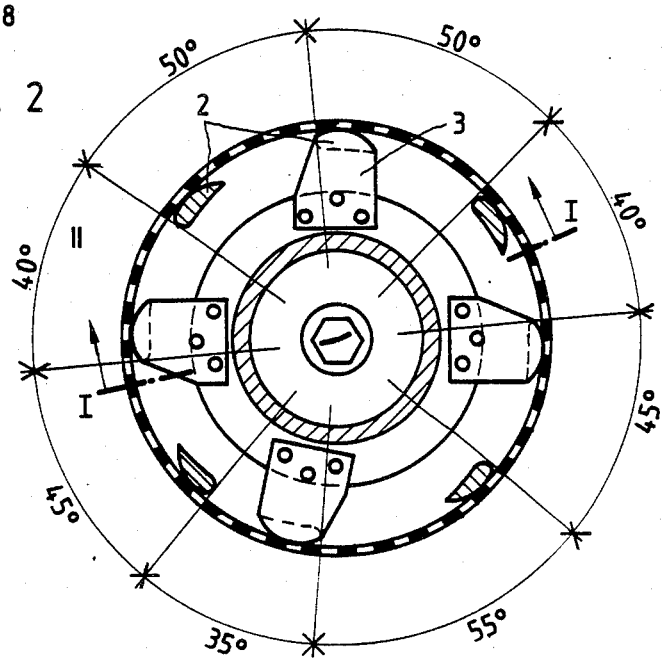

Referring to FIG. 2, as shown by the phantom guide lines and figures, the included angles between adjacent screening vanes 2 is not the same, i.e. there is an irregular spacing of the screening vanes 2. There is to assist in minimizing the pulsations produced by the screening vanes, as those pulsations would otherwise produce more noise from a band of clearly defined amplitudes.

Although the present invention has been described in connection with a preferred embodiment thereof, many variations will now become apparent to those skilled in the art. It is preferred, therefore, that the present invention be limited not by the specific disclosure herein, but only by the appended claims.

What is claimed is:

1. A sorter for paper pulp suspension, comprising:

a screen comprising a stationary, rotationally symmetrical wire cage having an internal periphery, the pulp suspension being moved through the wire cage from the internal periphery outwardly; the cage having an inlet through whieh suspension is fed into the cage;

a plurality of vanes disposed at the internal periphery of the cage, and a rotor for rotating the vanes to move past the internal periphery of the cage and to move the suspension through the wire screen;

an annular pulp chamber surrounding the cage for receiving pulp that has moved through the cage; a pulp outlet being provided for conducting pulp from the pulp chamber;

a damping chamber separate from the pulp chamber and disposed between the pulp outlet from the pulp chamber and the pulp chamber, such that pulp passes from the pulp chamber past the damping chamber to the pulp outlet, and the damping chamber being so placed that the suspension from the pulp chamber rises in the damping chamber to form a pool therein;

means defining a cushion providing gas pressure in the damping chamber for gas pressurizing the suspension in the damping chamber, thereby for damping the motion of the suspension from the pulp chamber to the pulp outlet; and a second outlet communicating with the interior of the cage for removing therefrom suspension which is not passed through the cage.

2. The sorter of claim 1, wherein the damping chamber directly communicates with one axial end of the pulp chamber and the suspension inlet is in communication with the cage toward the other end of the pulp chamber.

3. The sorter of claim 2, wherein the damping chamber is annular and surrounds the pulp chamber.

4. The sorter of claim 1, wherein the damping chamber is annular and surrounds the pulp chamber.

5. The sorter of claim 4, wherein the damping chamber extends axially along the height of the pulp chamber from the vicinity of the pulp outlet at least partially up toward the suspension inlet.

6. The sorter of claim 5, wherein the wire cage has an outlet axial end and the pulp chamber extends axially beyond the outlet axial end of the wire cage.

7. The sorter of claim 1, wherein the wire cage has an outlet axial end and the pulp chamber extends axially beyond the outlet axial end of the wire cage.

8. The sorter of claim 1, wherein the means defining a cushion comprises means for supplying a controlled gas pressure in the damping chamber and the damping chamber being closed for being controlled pressurized.

9. The sorter of claim 1, wherein the vanes are supported on a rotor, and the rotor is rotatable for moving the vanes around the internal periphery of the wire cage.

10. The sorter of claim 9, wherein the vanes are nonuniformly spaced around the internal periphery and are supported on the rotor there.

11. The sorter of claim 1, wherein the wire cage is oriented vertically and the rotor rotates about a vertical axis.

* * * * *